US007976326B2

(12) United States Patent
Stoner

(10) Patent No.: US 7,976,326 B2
(45) Date of Patent: Jul. 12, 2011

(54) GENDER-NEUTRAL ELECTRICAL CONNECTOR

(75) Inventor: Stuart C. Stoner, Lewisberry, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 12/649,603

(22) Filed: Dec. 30, 2009

(65) Prior Publication Data

US 2010/0167569 A1 Jul. 1, 2010

Related U.S. Application Data

(60) Provisional application No. 61/142,003, filed on Dec. 31, 2008.

(51) Int. Cl.
*H01R 13/502* (2006.01)

(52) U.S. Cl. ..... 439/295; 439/74; 439/660; 439/862

(58) Field of Classification Search ..... 439/660, 439/862, 295, 290, 291, 284, 74
See application file for complete search history.

(56) References Cited

U.S. PATENT DOCUMENTS

| | | | | |
|---|---|---|---|---|
| 3,072,340 | A | | 1/1963 | Dean |
| 3,157,448 | A | | 11/1964 | Crimmins et al. |
| 3,193,793 | A | * | 7/1965 | Plunkett et al. ..... 439/660 |
| 3,482,201 | A | | 12/1969 | Schneck |
| 3,663,925 | A | | 5/1972 | Proctor |
| 3,827,007 | A | | 7/1974 | Fairbairn et al. |
| 3,867,008 | A | | 2/1975 | Gartland, Jr. |
| 4,232,924 | A | | 11/1980 | Kline et al. |
| 4,482,937 | A | | 11/1984 | Berg |
| 4,664,456 | A | | 5/1987 | Blair et al. |
| 4,664,458 | A | | 5/1987 | Worth |
| 4,820,182 | A | * | 4/1989 | Harwath et al. ..... 439/290 |
| 5,030,121 | A | | 7/1991 | Noorily |
| 5,035,639 | A | | 7/1991 | Kilpatrick |
| 5,055,054 | A | | 10/1991 | Doutrich |
| 5,098,311 | A | * | 3/1992 | Roath et al. ..... 439/295 |
| 5,127,839 | A | | 7/1992 | Korsunsky et al. |
| 5,167,528 | A | | 12/1992 | Nishiyama et al. |
| 5,181,855 | A | | 1/1993 | Mosquera et al. |
| 5,382,168 | A | | 1/1995 | Azuma et al. |
| 5,395,250 | A | | 3/1995 | Englert et al. |
| 5,498,167 | A | | 3/1996 | Seto et al. |
| 5,520,545 | A | | 5/1996 | Sipe |
| 5,697,799 | A | | 12/1997 | Consoli et al. |
| 5,871,362 | A | | 2/1999 | Campbell et al. |
| 5,893,761 | A | | 4/1999 | Longueville |
| 5,902,136 | A | | 5/1999 | Lemke et al. |
| 5,904,581 | A | | 5/1999 | Pope et al. |
| 5,984,690 | A | | 11/1999 | Riechelmann et al. |

(Continued)

OTHER PUBLICATIONS

In the United States Patent and Trademark Office, Final Office Action in re:. U.S. Appl. No. 12/237,756, filed Sep. 25, 2008, Dated Dec. 3, 2009, 9 pages.

(Continued)

*Primary Examiner* — Gary F. Paumen
(74) *Attorney, Agent, or Firm* — Woodcock Washburn LLP

(57) ABSTRACT

An electrical connector assembly includes a pair of electrical connectors, each having a housing and a plurality of gender-neutral electrical contacts supported by the housing. The gender-neutral contacts of each connector are configured to mate with the gender-neutral contacts of the other connector, such that insertion forces associated with mating the contacts provide tactile feedback as the contacts are mated.

25 Claims, 10 Drawing Sheets

U.S. PATENT DOCUMENTS

| | | | | |
|---|---|---|---|---|
| 5,992,953 | A | 11/1999 | Rabinovitz | |
| 6,022,227 | A | 2/2000 | Huang | |
| 6,068,519 | A * | 5/2000 | Lok | 439/660 |
| 6,074,230 | A | 6/2000 | Comerci et al. | |
| 6,152,747 | A | 11/2000 | McNamara | |
| 6,154,742 | A | 11/2000 | Herriot | |
| 6,183,301 | B1 | 2/2001 | Paagman | |
| 6,193,537 | B1 | 2/2001 | Harper, Jr. et al. | |
| 6,270,379 | B1 * | 8/2001 | Huang et al. | 439/660 |
| 6,379,170 | B1 | 4/2002 | Czeschka et al. | |
| 6,390,826 | B1 | 5/2002 | Affolter et al. | |
| 6,409,546 | B1 * | 6/2002 | Ito et al. | 439/630 |
| 6,494,734 | B1 | 12/2002 | Shuey | |
| 6,537,087 | B2 | 3/2003 | McNamara et al. | |
| 6,540,529 | B1 | 4/2003 | Yu | |
| 6,641,410 | B2 | 11/2003 | Marvin et al. | |
| 6,699,048 | B2 | 3/2004 | Johnson et al. | |
| 6,712,626 | B2 | 3/2004 | Harper, Jr. et al. | |
| 6,835,072 | B2 | 12/2004 | Simons et al. | |
| 6,851,954 | B2 * | 2/2005 | Ashman et al. | 439/70 |
| 6,860,741 | B2 | 3/2005 | Ashman et al. | |
| 6,869,292 | B2 | 3/2005 | Johnescu et al. | |
| 6,893,300 | B2 | 5/2005 | Zhou et al. | |
| 6,902,411 | B2 | 6/2005 | Kubo | |
| 6,918,776 | B2 | 7/2005 | Spink, Jr. | |
| 6,939,173 | B1 | 9/2005 | Elco et al. | |
| 6,951,466 | B2 | 10/2005 | Sandoval et al. | |
| 7,156,705 | B2 * | 1/2007 | Soh | 439/862 |
| 7,182,608 | B2 | 2/2007 | Soh et al. | |
| 7,214,104 | B2 | 5/2007 | Minich et al. | |
| 7,220,141 | B2 | 5/2007 | Daily et al. | |
| 7,452,249 | B2 | 11/2008 | Daily et al. | |
| 7,575,469 | B1 * | 8/2009 | Hung | 439/500 |
| 7,789,716 | B2 | 9/2010 | Fedder et al. | |
| 2002/0127903 | A1 | 9/2002 | Billman et al. | |
| 2004/0157477 | A1 | 8/2004 | Johnson et al. | |
| 2005/0079763 | A1 | 4/2005 | Lemke et al. | |
| 2005/0101188 | A1 | 5/2005 | Benham et al. | |
| 2005/0277315 | A1 | 12/2005 | Mongold et al. | |
| 2006/0051987 | A1 | 3/2006 | Goodman et al. | |
| 2006/0148283 | A1 | 7/2006 | Minich et al. | |
| 2006/0172570 | A1 | 8/2006 | Minich et al. | |
| 2006/0276085 | A1 * | 12/2006 | Ma et al. | 439/862 |
| 2007/0004287 | A1 | 1/2007 | Marshall | |

OTHER PUBLICATIONS

In the United States Patent and Trademark Office, Non-Final Office Action in re:. U.S. Appl. No. 12/237,756, filed Sep. 25, 2008, Dated Jun. 22, 2009, 8 pages.

In the United States Patent and Trademark Office, Non-Final Office Action in re:. U.S. Appl. No. 12/237,756, filed Sep. 25, 2008, Dated Jun. 9, 2010, 11 pages.

In the United States Patent and Trademark Office, Request for Continuation in re:. U.S. Appl. No. 12/237,756, filed Sep. 25, 2008, Dated Mar. 3, 2010, 3 pages.

MicroStac 0,8 mm Mezzanine Steckverbindersystem, www.emi.com, Katalog D 074520, Feb. 2008, 24 pages.

* cited by examiner

GENDER-NEUTRAL ELECTRICAL CONNECTOR

CROSS-REFERENCE TO RELATED APPLICATIONS

This application claims priority to U.S. Patent Application Ser. No. 61/142,003, filed Dec. 31, 2008, the disclosure of which is hereby incorporated by reference as if set forth in its entirety herein.

This disclosure is related to U.S. patent application Ser. No. 12/237,756 filed Sep. 25, 2008, the disclosure of which is hereby incorporated by reference as if set forth in its entirety herein.

BACKGROUND

The present invention generally relates to electrical contacts of electrical connectors, and in particular relates to gender-neutral electrical contacts.

Electrical connector assemblies include electrical connectors that can attach to provide signal connections between electronic devices. In particular, each electrical connector includes electrical signal contacts that are provided as male that receive complementary female contacts, or female contacts that are inserted into complementary male contacts. The gender-specific contacts can require specialized connectors that are configured to connect with a mating connector. Furthermore, the connectors need to be precisely aligned for connection.

Hermaphroditic, or gender-neutral, electrical connectors have been introduced that allow for general interchangeability between connectors of a connector assembly. Conventional gender-neutral electrical contacts extend out from a housing, and have an offset region, such that the offset regions of contacts to be mated are aligned. Thus, when the connectors are mated, the offset regions of the electrical cam over each other, thereby causing resistance to insertion, and requiring an insertion force in order to mate the connectors. Unfortunately, the insertion force increases as the connectors are brought toward each other to their fully mated positions, which can lead to significant wear of the contacts.

What is therefore desired is an electrical connector having gender-neutral contacts that reduce the insertion forces with respect to conventional electrical connectors.

SUMMARY

In accordance with one aspect, an electrical connector includes a housing and at least one electrical contact supported by the housing. The electrical contact defines a contact body extending out from the housing, a mounting end disposed upstream of the contact body, and a mating end disposed downstream of the contact body. The mating end extends inward toward the housing such that the mating end is spaced from the contact body. The mating end defines mating surface having a concave region and a convex region disposed downstream of the concave region. The convex region defines a peak disposed between a pair of downsloped surfaces that extend toward the contact body in a direction outward from the peak.

One aspect of the invention is a connector system that requires less force to mate two mating connectors together. The geometry of the electrical contacts helps to gradually overcome frictional and normal forces of mating electrical contacts, as a function of mating distance, thereby decreasing the amount of externally applied mating force needed to press mating connectors closer to one another. Stated another way, when one starts to press two of the mating connectors together, less force is required to continue mating the two mating connectors. The decrease in external mating force continues until the mating connectors are fully mated.

DETAILED DESCRIPTION OF ILLUSTRATIVE EMBODIMENTS

Figure 1:
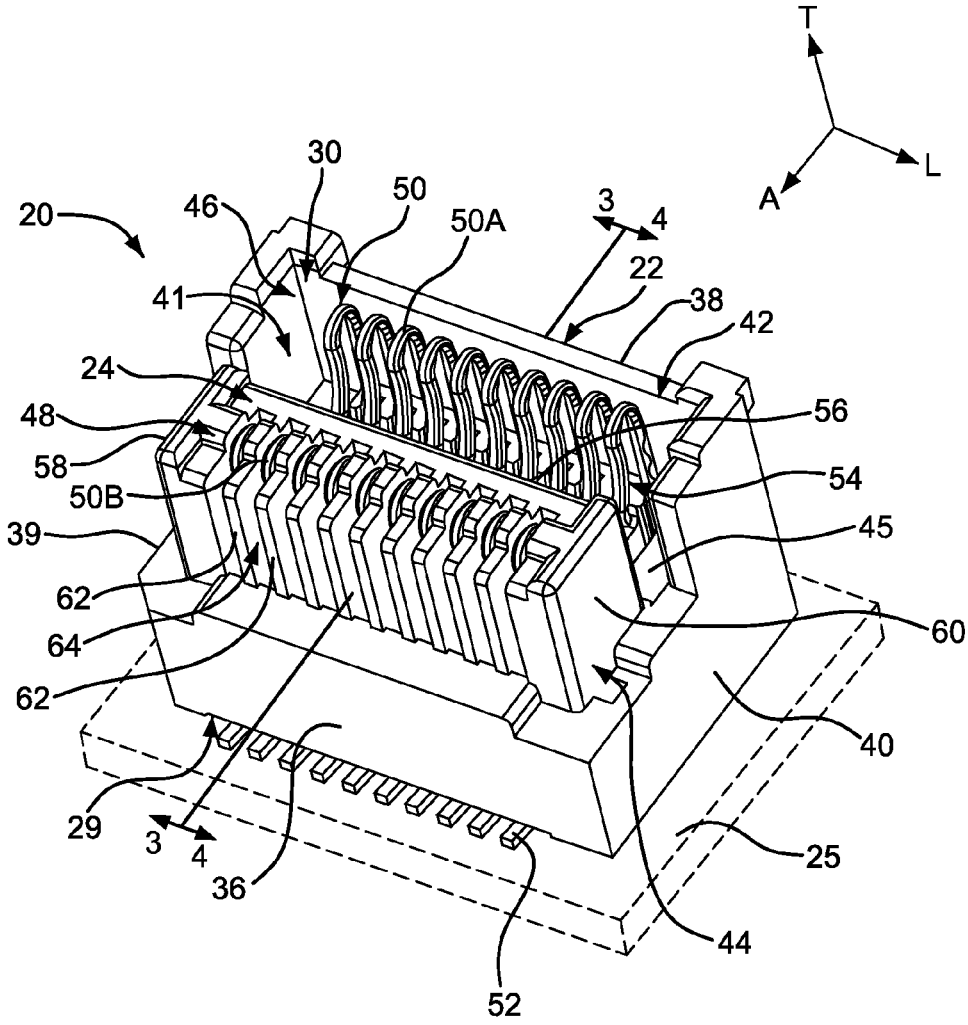
FIG. 1 is a perspective view of an electrical connector constructed in accordance with one embodiment.

Referring to FIG. 1, an electrical connector 20 is illustrated as horizontally along a longitudinal direction "L" and lateral direction "A", and vertically along a transverse direction "T". The connector 20 is generally rectangular in shape, and is elongate along its length that extends along the longitudinal direction L, has width that extends along the lateral direction A, and has a height that extends along the transverse direction T. Unless otherwise specified herein, the terms "lateral," "longitudinal," and "transverse" are used to describe the orthogonal directional components of the connector 20 and the components of the connector 20.

Certain directional terminology may be used in the following description for convenience only and should not be considered as limiting in any way. For instance, while the longitudinal and lateral directions are illustrated as extending along a horizontal plane, and that the transverse direction is illustrated as extending along a vertical plane, the planes that encompass the various directions may differ during use, depending, for instance, on the desired orientation of the electrical connector 20. Accordingly, the terms "vertical," "horizontal," and derivatives thereof are used to describe the connector 20 as illustrated merely for the purposes of clarity and convenience, it being appreciated that these orientations may change during use. Likewise, unless otherwise indicated, the terms "upper," "lower," "inner," "outer," and derivatives thereof designate directions along a given directional component toward and away from, respectively, the geometric center of the referenced object.

The connector 20 includes a connector housing 22 defining a mounting end 29 and a mating end 30. The connector housing 22 supports an electrical contact assembly 24 that includes a plurality of electrically conductive contacts 50 retained in the housing 22. Each contact has a first mounting end 52 disposed proximate to the mounting end 29 of the housing 22, and a second mating end 54 disposed proximate to the mating end 30 of the housing 22. The mounting end 29 of the housing is configured for attachment to a complementary electrical component, such as a printed circuit board 25. Thus, the mounting ends 52 of the contacts 50 are configured to connect to electrical traces on the circuit board 25.

Figure 4:
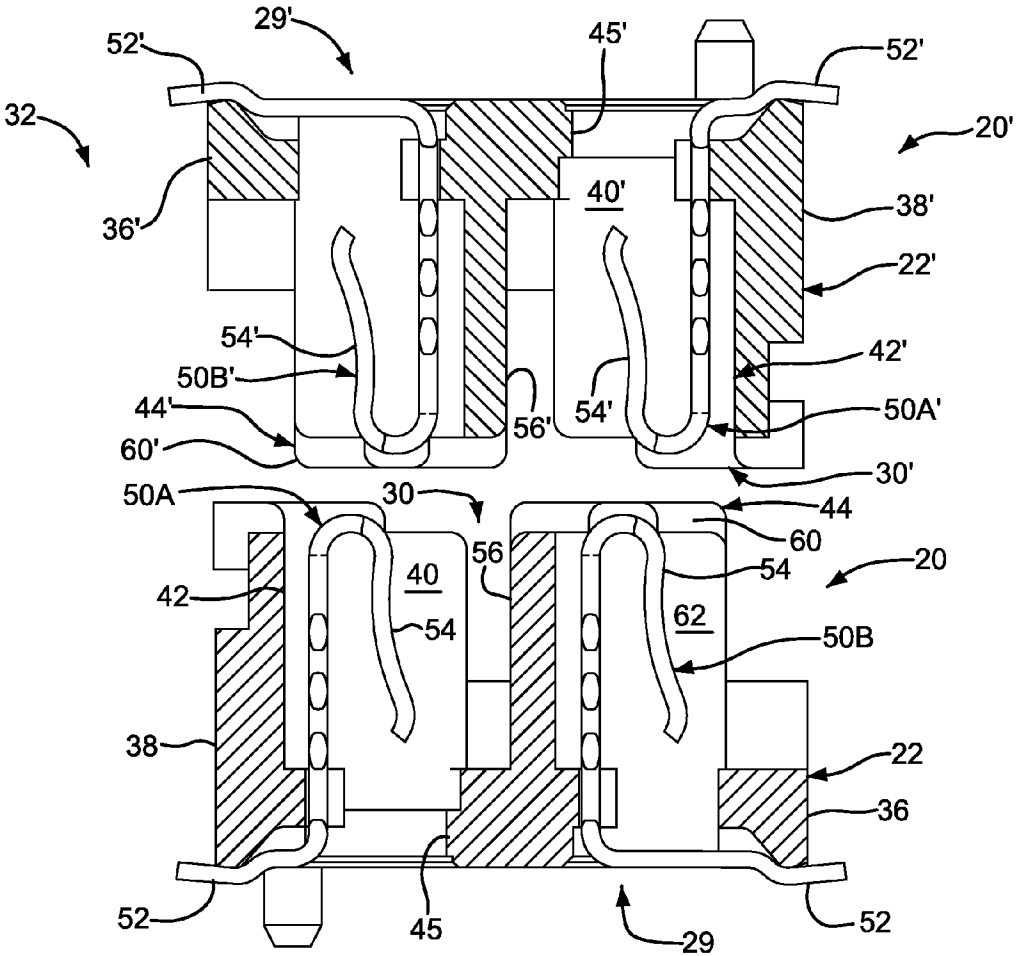
FIG. 4 is a sectional side elevation view of an electrical connector assembly including a pair of connectors taken along line 4-4 of FIG. 1 prior to mating.
Figure 7:
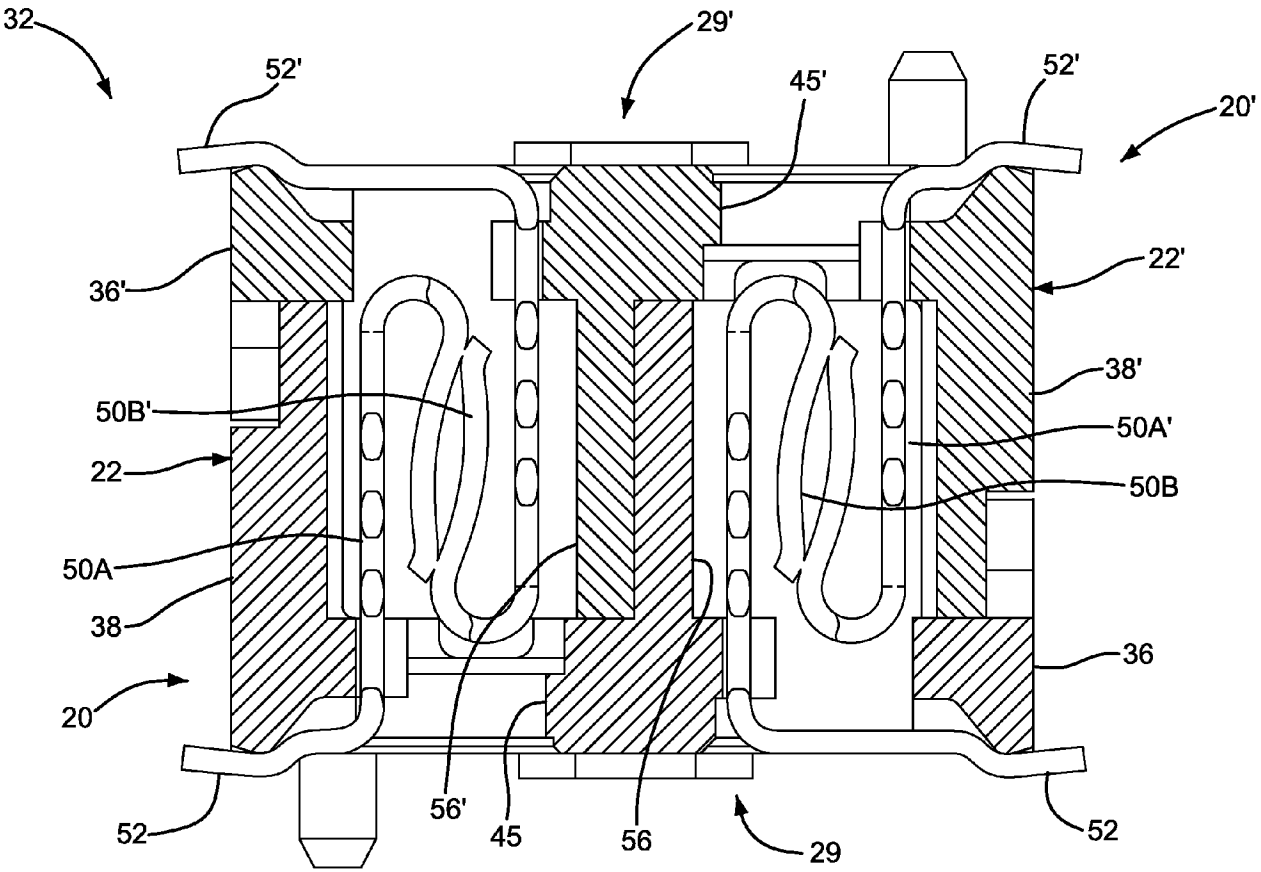
FIG. 7 is a side elevation view similar to FIG. 4, but showing the electrical connectors in the fully mated position.

Referring also to FIGS. 4 and 7, a connector assembly 32 includes first and second complementary electrical connectors 20 and 20' that are each configured for attachment to each other at one end, and an electrical component such as a printed circuit board at another end. It should be appreciated, however, that the electrical connector 20 could alternatively be configured to connect other electrical components as desired, such as cables, terminals, and the like. Unless otherwise indicated, the connectors 20 and 20' can be substantially identically constructed. Accordingly the connector 20 will be described, it being appreciated that the description of the connector 20 equally applies to the connector 20' unless otherwise indicated. Hence, elements of connector 20' that correspond to elements of connector 20 will be designated with an apostrophe ('). Thus, mating end 30 of the housing 22 is configured to mate with a corresponding mating end 30' of the complementary electrical connector 20' when the complementary electrical connector 20' is mated to the electrical connector 20. Thus, the mating ends 54 of the contacts are configured to mate with mating ends 54' of the complementary electrical contacts 50'. As will be appreciated from the description below, the mating ends 54 of the contacts 50 are hermaphroditic, or gender-neutral, thereby allowing for general interchangeability between connectors of the connector assembly 32.

In the illustrated embodiment, the connector assembly 32 is a vertical or mezzanine connector assembly, whereby the mating ends of the connectors 20 and 20' are parallel to the mounting ends of the vertical or mezzanine connectors. Hence, the printed circuit boards 25 or other electrical components can be oriented parallel to each other. However, the connectors 20 and 20' could be alternatively configured. For instance, in alternative embodiments, one or both of the electrical connector could be configured as a right-angle connector whereby the mounting end extends in a direction substantially perpendicular to the mating end. Thus, the electrical connectors 20 and 20' and the electrical connector assembly 32 are not intended to be vertical or mezzanine, or right-angle unless otherwise indicated.

Figure 2:
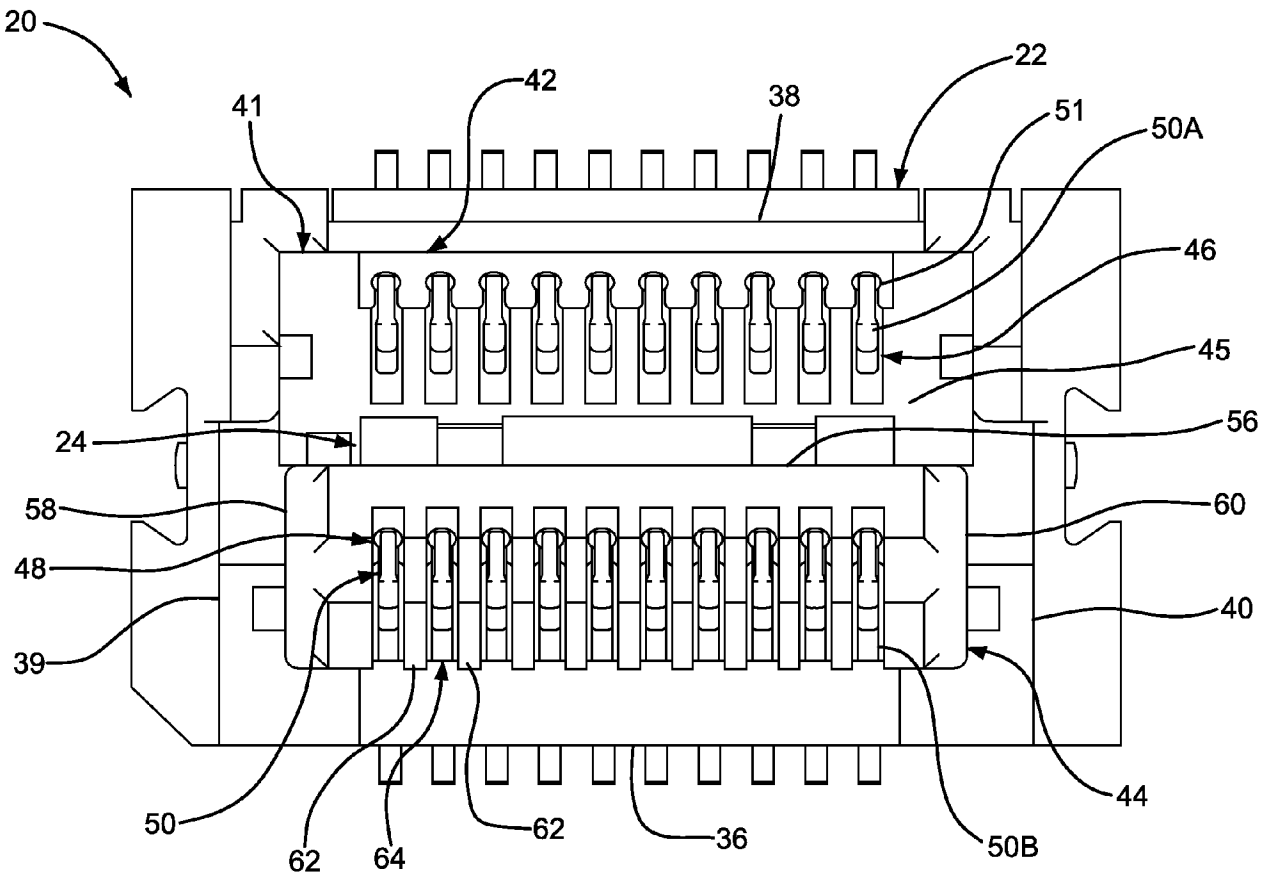
FIG. 2 is a top plan view of the electrical connector illustrated in FIG. 1.
Figure 3:
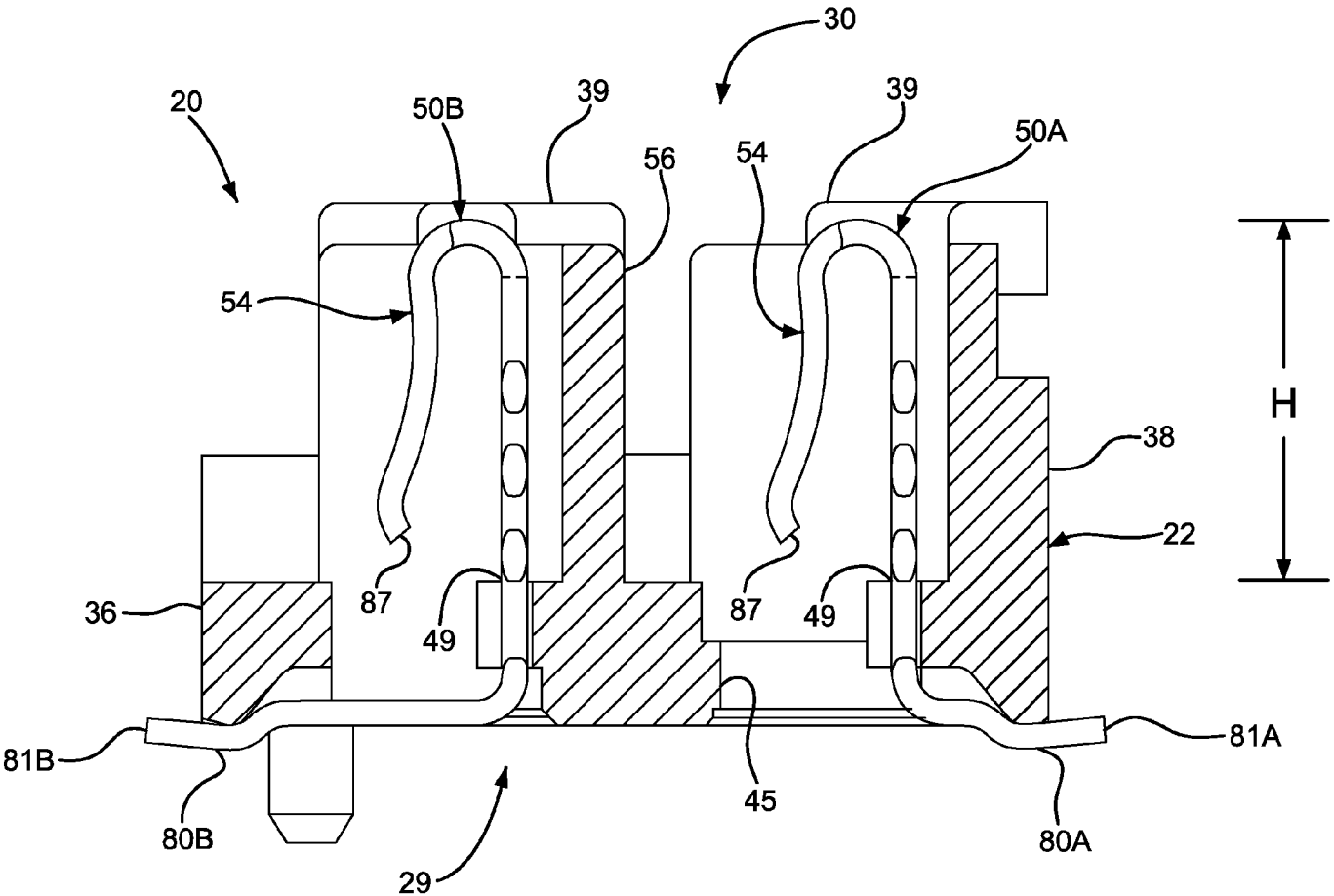
FIG. 3 is a sectional side elevation view of the electrical connector illustrated in FIG. 1 taken along line 3-3.

The first electrical connector 20 will now be further described with reference to FIGS. 1-3. The connector housing 22 can be formed from a dielectric material, such as plastic, for example. The connector housing 22 a pair of opposing longitudinally elongate vertical side walls 36 and 38 connected at their longitudinally outer ends to first and second opposing laterally elongate vertical end walls 39 and 40, respectively. The side wall 38 has a height greater than the side wall 36, and the end walls 39 and 40 have a height that is greater proximate to the side wall 38 than proximate to the side wall 36. The side walls 36 and 38 and end walls 39 and 40 define a void 41 that retains the electrical contact assembly 24.

The electrical contact assembly 24 includes a receptacle portion 42 and a header portion 44. A first row 46 of longitudinally spaced electrical contacts 50A is disposed in the receptacle portion 42, and a second row 48 of longitudinally spaced electrical contacts 50B is disposed in the header portion 44. The electrical contact assembly 24 includes a base 45 that supports the electrical contacts 50 in any desired manner. For instance, the base 45 can be formed from a resin or other suitable dielectric material that is injection molded around the lower ends of the contacts 50 such that the mounting ends 52 are exposed and configured to mate with the printed circuit board 25. The contacts 50 extend up through vertical, and laterally elongate, slots 51 formed in the base 45.

The receptacle portion 42 of the contact assembly 24 is defined by the side wall 38, the end walls 39 and 40 and a longitudinal vertical divider wall 56 that extends between the end walls 39 and 40. The divider wall 56 separates the receptacle portion 42 from the header portion 44.

The header portion 44 is defined by a pair of inner end walls 58 and 60 that are inwardly displaced from the end walls 39 and 40, and the divider wall 56 that extends between the inner end walls 58 and 60. A plurality of dividers 62 extend laterally outward from the divider wall 56 into the header portion 44. The dividers 62 are vertically oriented, extend between the divider wall 56 and the side wall 36, and are longitudinally spaced from each other such that contact-receiving voids 64 are disposed between adjacent dividers 62. The contact-receiving voids 64 are vertically aligned with the slots 51 formed in the base 45. The electrical contacts 50A in the first row 46 are aligned with the electrical contacts 50B in the second row 48.

The longitudinal distance between the longitudinally outer surfaces of the end walls 58 and 60 is substantially equal to, or slightly less than, the longitudinal distance between the longitudinally inner surfaces of the end walls 39 and 40 at the receptacle portion 42. Furthermore, the lateral distance between the longitudinally outer surfaces of the divider wall 56 and the inner end walls 58 and 60 and dividers 62 of the header portion 44 is substantially equal to, or slightly less than, the lateral distance between the laterally inner surfaces of the side wall 38 and the divider wall 56 of the receptacle 42.

Accordingly, referring to FIGS. 4 and 7, when the connectors 20 and 20' are mated to form the connector assembly 32, the receptacle portion 42 is received by the header portion 44' of the complementary connector 20', and the header portion 44 receives the receptacle portion 42' of the complementary connector 20'. Furthermore, because the contacts 50A and 50B of each row 46 and 48 are aligned, the contacts 50A disposed in the receptacle portion 42 of the connector 20 mate with the contacts 50B' disposed in the header portion 44' of the connector 20', and the contacts 50B in the header portion 44 of the connector 20 mate with the contacts 50A' disposed in the receptacle portion 42' of the connector 20'.

Furthermore, the lateral distance between the electrical contacts 50A of the first row 46 and the side wall 38 is less than the lateral distance between the electrical contacts 50B of the second row 48 and the side wall 36. Accordingly, when the connectors 20 and 20' mate such that the side wall 38 is aligned with the side wall 40', and the side wall 40 is aligned with the side wall 38', the contacts 50A and 50B of the connectors are laterally offset from each other and can mate with each other in the manner described below.

It should be appreciated that when the connectors 20 and 20' are mated, an insertion force is required to overcome the frictional forces generated by the housings 22 and 22' during mating, as well as the frictional forces generated by the electrical contacts 50 and 50'during mating. As will now be described with reference to FIGS. 5-6, the mating ends 54 of the electrical contacts 50 and 50' are gender-neutral, and are configured to reduce the insertion force required to mating the connectors 20 and 20' with respect to the insertion force associated with mating conventional connectors.

Figure 5A:
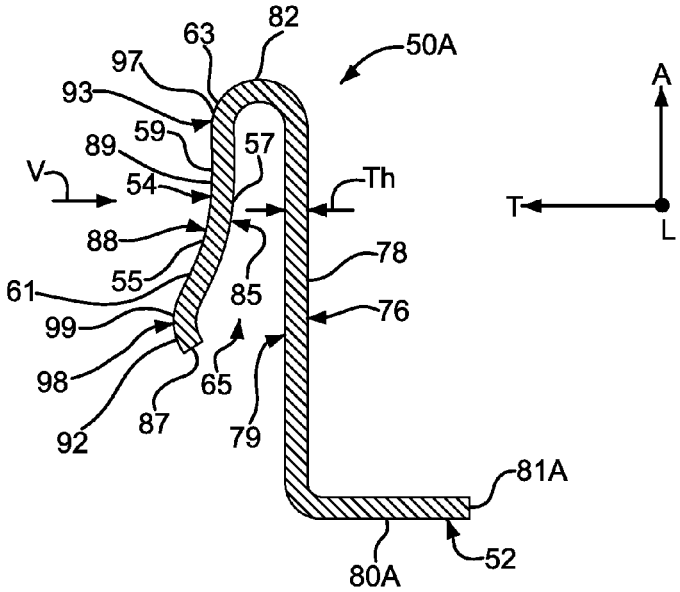
FIG. 5A is a side elevation view of one of the electrical contacts disposed in a first row of one of the electrical connectors of the electrical connector assembly illustrated in FIG. 4.
Figure 5B:
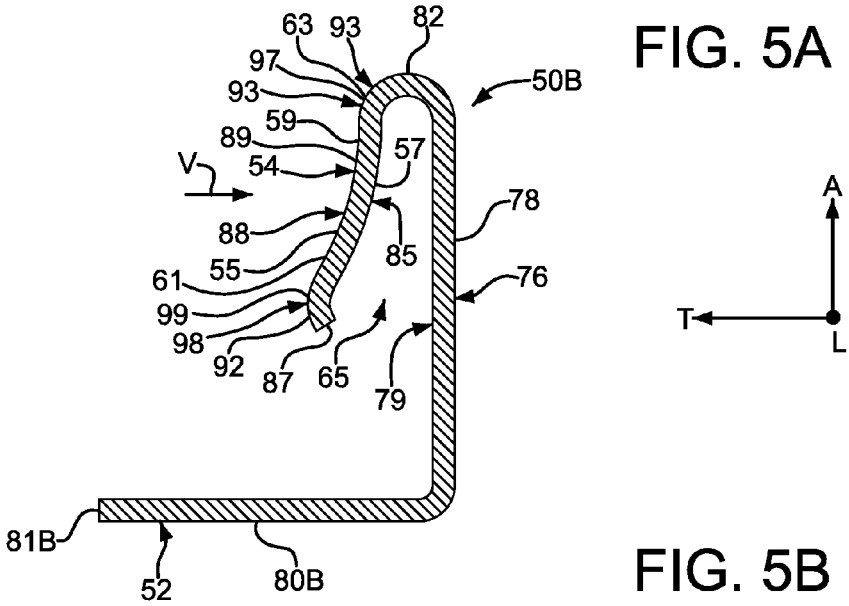
FIG. 5B is a side elevation view similar to FIG. 5A, but of one of the electrical contacts disposed in a second row of the electrical connector.

Referring to FIGS. 5A-B, the electrical contacts 50A and 50B are illustrated, respectively, with the housing 22 removed for the purposes of clarity. It should be appreciated that while the external electrical components are not shown as attached to the contacts 50A-B, but the contacts 50A-B could be pre-attached to the electrical component if desired, or provided separate from the electrical component and later connected to an electrical component.

It should be further appreciated that all of the electrical contacts 50A are identically or substantially identically constructed, and all of the electrical contacts 50B are identically or substantially identically constructed. Accordingly, the description of the electrical contact 50A is applicable to all electrical contacts 50A and 50A' unless otherwise indicated, and the description of the electrical contact 50B is applicable to all electrical contacts 50B and 50B' unless otherwise indicated. Furthermore, because the electrical contacts 50A and 50B are identically or substantially identically constructed, except as to the configuration of the mounting ends 52A and 52B, the electrical contacts 50A and 50B are otherwise described with reference to like reference numbers identifying like structure. Therefore, a reference made to an electrical contact 50 and structure thereof applies equally to both electrical contacts 50A and 50B.

As illustrated, the electrical contact 50 is an electrical signal contact configured to transfer data between a signal contact of the complementary connector 20' and the electrical component, such as the printed circuit board 25, though it should be appreciated that the contact 50 could alternatively be provided as a power contact unless otherwise indicated. In one embodiment, the electrical contact is made from any suitably electrically conductive material, such as a copper alloy. The contact can have thickness Th of 0.15 mm, though any thickness can be used depending upon the desired insertion force characteristics and normal force characteristics at the locations of contact of the complementary mated ends 54 and 54'. Each electrical contact 50 defines a contact body 76 that can define a round, for instance circular, cross section as illustrated, or can alternatively have a cross section that defines a square, rectangular, or any alternative suitable geometry. The contact 50 can be made from any suitable electrically conductive material, and can be sufficiently flexible such that the contact 50 can deflect or yield when being mated to the associated contact 50'.

The contact body 76 can define a vertical stem 78, and a bent portion 82 connected to the upper end of the stem 78. The bent portion 82 can be substantially "U" shaped so as to define a hairpin turn, and curves laterally outward and downward from the stem 78 so as to define a distal portion 85 disposed downstream of the bent portion 82. The distal portion 85 is thus laterally spaced from the stem 78. Accordingly, the stem 78 defines a proximal portion 79 of the contact 50 extending transversely outward from the base 45 of the housing 22 and laterally spaced from the distal portion 85 by a gap 65. The distal portion 85 extends transversely inward from the bent portion 82 toward the base 45 of the housing 22. The bent portion 82 separates the proximal portion 79 of the contact body 76 from the distal portion 85 of the contact body. The distal portion 85 defines the mating end 54 of the contact 50, and terminates at a free terminal end 87. The mounting end 52 is disposed proximal to or upstream of the contact body 76, and the mating end 54 is disposed distal to or downstream of the contact body 76.

The mating end 54 extends generally transversely inward (or down) toward the base 45 of the housing, and laterally outward away from the contact body 76 or stem 78. Because the mating end 54 has a transversely inward directional component and the body 76 or stem 78 has a transversely outward (or upward) component, it can be said that the bent portion 82 causes the mating end 54 to extend in an opposite direction with respect to the body 76 or stem 78. Furthermore, the mating end 54 is in at least partial lateral alignment with, or laterally overlaps, the contact body 76 or stem 78 such that a common axis that extends in a direction perpendicular to the contact body 76 or stem 78, for instance in the lateral direction, extends through both the mating end 54 and the body 76 or stem 78. The mating end 54 defines a laterally outer mating surface 55 configured to engage the mating surface 55' of the complementary contact 50', and an opposing inner surface 57 that faces the body 76 or stem 78.

The proximal and distal portions 79 and 85 of the contacts 50B are at least partially disposed in the contact-receiving voids 64 of the header portion 44 (see FIG. 1). Accordingly, the contacts 50B are configured to mate with complementary contacts 50A' the contact-receiving voids 64 in the manner described below.

In this regard, it should be appreciated that while the directional terms "laterally inward" and "laterally outward" and derivatives thereof used with reference to the distal portion 85 refer to a direction toward and away from the proximal portion 79, respectively, it should be further appreciated that these directional terms further refer to a direction along the mating surface 55 away from and towards, respectively, the complementary contact 50' as the contacts 50 and 50' are mated.

As used herein, the directional term "distal," "downstream" and derivatives thereof are used to refer to directions along the contact 50 from the proximal portion 79 toward the distal portion distal portion 85. Thus, a distal direction of the proximal portion 79 extends generally upward in the illustrated orientation of the contact 50, and a distal direction of the distal portion 85 extends generally downward. The directional term "proximal," "upstream", and derivatives thereof refers to a direction along the contact 50 opposite that of the distal or downstream direction.

The stem 78 extends down from the bent portion 82, and connects to a base portion 80 that extends laterally outward from the lower end of the stem 78, and defines the mounting end 52 of the contact 50. In particular, the base portion 80A of the contact 50A extends laterally out from the stem 78 in a direction opposite the direction that the distal portion 85 is offset from the proximal portion 79. Thus, the base portion 80A extends in a direction toward the side wall 38 of the connector housing 22 (see FIG. 3). The base portion 80A defines a terminal end 81A, and has a length sufficient such that the terminal end 81A extends laterally outward of the side wall 38 to facilitate connection to an electrical component. The base portion 80B of the contact 50B extends laterally out from the stem 78 in the same direction that the distal portion 85 is offset from the proximal portion 79. Thus, the base portion 80B extends in a direction toward the side wall 36 of the connector housing 22 (see FIG. 3). The base portion 80B defines a terminal end 81B, and has a length sufficient such that the terminal end 81B extends laterally outward of the side wall 36 to facilitate connection to an electrical component.

With continuing reference to FIGS. 5A-B, various regions of the distal end 85 of the contacts 50 will be described as being concave or convex. It should be appreciated that the terms "concave" and "convex" are used herein with reference to a direction of extension along the contact, and in relation to a view normal to the concave or convex region toward the mating surface 55, for instance along the general direction indicated by Arrow V. A concave region of the distal portion 85 can thus be described as including a pair of opposing transverse outer ends, or peaks, and a transverse middle portion, or valley, disposed between the peaks, whereby the valley is disposed inward or recessed from the transverse outer ends with respect to a normal view toward the mating surface 55. Otherwise stated, the transverse outer ends are disposed outward from the valley. A convex surface of the distal portion 85 includes a pair of opposing transverse outer ends, or valleys, and a transverse middle portion, or peak, disposed between the transverse outer ends, whereby the peak is disposed outward from the valleys with respect to a normal view toward the mating surface 55. Otherwise stated, the valleys define surfaces that are recessed with respect to the peak.

It should be appreciated that one or both of the transverse outer ends of a convex or concave region can define a transverse outer end of an adjacent concave or convex region, respectively. The transitions between the adjacent concave and convex regions, and the transitions between transverse outer ends and the transverse inner ends of the concave and convex regions can define a smooth and constant radius of curvature, though it should be appreciated that the transitions could be defined by any suitable shape as desired, including angles as opposed to curved surfaces. Accordingly, reference to convex, concave, and curved surfaces or regions should not be construed as being limited to curvatures.

As will now be described with continuing reference to FIGS. 5A-B, the distal portion 85 defines a proximal convex region 93 and a distal convex region 98, and a concave region 88 disposed between the proximal and distal convex regions 93 and 98.

In particular, the bent portion 82 extends distally from the stem 78 along a radius of curvature, and extends greater than 180° from the stem 78, thereby providing the proximal convex region 93. The proximal convex region 93 includes a peak 97 that defines first contact location as a pair of contacts 50 and 50' are mated. Thus, the convex region 93 defines an upsloped surface 63 disposed between the bent portion 82 and the peak 97. The upsloped surface 63 is configured to provide an insertion force as the contacts 50 and 50' are mated relative to the insertion force provided by the downsloped surface 59, thereby providing tactile feedback during insertion. The bent portion 82, and thus the convex region 93, can be defined by any radius of curvature as desired, such as between 0.1 mm and 0.6 mm, or more preferably between 0.3 mm and 0.4 mm. In one embodiment, the radius of curvature of the bent portion 82 is approximately 0.35 mm.

The concave region 88 extends distally from the convex region 93. In the illustrated embodiment, the convex region 93 transitions directly into the concave region 88. The convex region 88 defines a valley 89, such that a downsloped surface 59 is disposed between the peak 97 of the convex region 93 and the valley 89. While the downsloped surface 59 extends laterally inward as illustrated, it should be further appreciated that a downsloped surface can be more broadly described as flaring laterally outward less than the surface proximal to the downsloped surface, which is the convex region 93 as illustrated with respect to the downsloped surface 59.

The concave region 88 can be defined by any radius of curvature as desired, such as between 0.5 mm and 0.4 mm, or more preferably between 1 mm and 3 mm. In one embodiment, the radius of curvature of the bent portion 82 is approximately 2 mm. Furthermore, in one embodiment, the concave region 88 defines a lateral distance that is between 300% and 500% with respect to the lateral distance defined by the proximal convex region 93, though any relative lateral distance of the concave region and the convex region 93 is contemplated. As will be described in more detail below, the concave region 88 is thus configured to produce a variable insertion forces as contacts 50 and 50' are mated.

The distal convex region 98 extends distally from the concave region 88. In the illustrated embodiment, the concave region transitions direction into the convex region 98. As will be appreciated from the description below, the convex region 98 defines a peak 99 that is laterally outwardly displaced with respect to the peak 97 of the convex region 93. second contact location as a pair of contacts 50 and 50' are mated. The concave region 88 defines a downsloped distal end 92 that flares laterally inward toward the stem 78 at a rate greater than that of the downsloped surface 59 of the concave region 88 in the illustrated embodiment, and terminates at the free terminal end 87. In an alternative embodiment, the terminal end 87 could connect to the vertical stem 78. The distal end 92 of the distal convex region 98 further defines the distal end of the concave portion 85 of the contact 50, and thus also defines the distal end of the contact 50. The distal concave region 98 can be defined by a radius of curvature substantially equal to that of the proximal convex region. Thus, the convex regions 93 and 98 change directions, or curve, at a greater rate than the concave region 88. Otherwise stated, the concave region 88 has a curvature that is shallower than that of the convex regions 93 and 98.

It should be appreciated that the convex region 88 further defines an upsloped surface 61 disposed between the valley 89 and the peak 99 of the distal convex region 98. While the upsloped surface 61 extends laterally outward as illustrated, it should be further appreciated that the downsloped surface can be more broadly described as flaring laterally inward less than the upstream surface, which is the downsloped surface 59 as illustrated. Thus, as described below, the upsloped surface 59 is configured to increase the insertion force as the contacts 50 and 50' are mated relative to the insertion force provided by the downsloped surface 59, thereby providing tactile feedback during insertion.

In the illustrated embodiment, the proximal convex region 93 is disposed immediately adjacent the concave region 88 such that the distal surface of the convex region 93 that is recessed with respect to the peak 97 also defines the downsloped surface 59. Likewise, the concave region 88 is disposed immediately adjacent the distal convex region 98. Accordingly, the peak 93 of the proximal convex region 93 is disposed between a pair of surfaces, namely the downsloped surface 59 and the bent portion 82, that slope inward from the peak 93 toward the stem 78 in opposing outward directions from the peak 93 along the mating end 54. The valley 89 of the concave region 88 is disposed between a pair of surfaces, namely the downsloped surface 59 and the upsloped surface 61, that slope outward from the valley 89 away from the stem 78 in opposing outward directions from the valley 89 along the mating end 54. Furthermore, the peak 99 of the distal convex region 98 is disposed between a pair of surfaces, namely the upsloped surface 61 and the downsloped surface 92, that slope inward from the 99 toward the stem 78 in opposing outward directions from the peak 99 along the mating end 54. It should be appreciated, however, that other structure at the distal portion could separate the proximal convex region 93 from the concave region 88, and the concave region 88 from the distal convex region 98, unless otherwise indicated. Accordingly, the regions 93, 88, and 98 can be said to be disposed adjacent to each other to indicate a spatial relationship without being limited to being disposed immediately adjacent each other, unless otherwise indicated. Additionally, the convex portion 85 can include additional convex and concave regions as desired.

The mating of the electrical contacts 50 and 50' will now be described with reference to FIGS. 6A-F, which illustrate one of the contacts 50B of the second row 48 of contacts 50 of the connector 20, and one of the contacts 50A' of the first row 46 of contacts 50' of the connector 20'. It should be appreciated that because the contacts 50A and 50A' are identically or substantially identically constructed, and the contacts 50B and 50B' are identically or substantially identically constructed, the description of the mating of the contacts 50A' and 50B equally applies to the mating of contacts 50A and 50B'. The connector housings 22 and 22' have been removed from FIGS. 6A-F for the purposes of clarity.

Figure 6A:
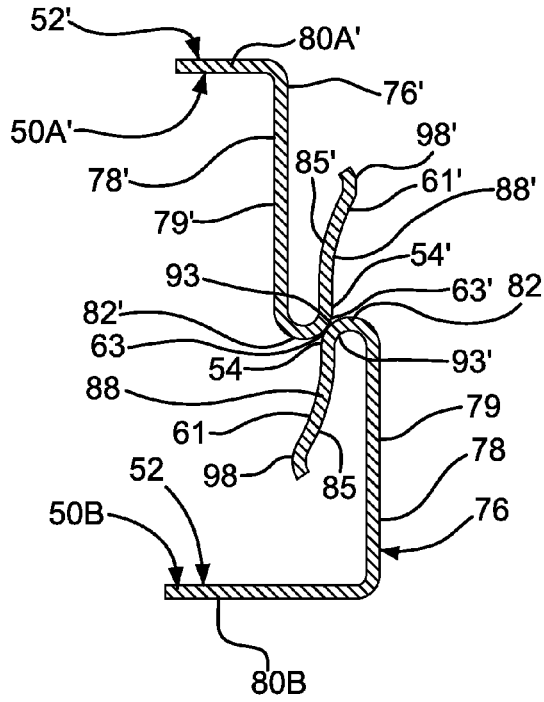
FIG. 6A is a side elevation view of a pair of contacts of the electrical connectors illustrated in FIG. 4 prior to mating.

With initial reference to FIG. 6A, the two contacts 50B and 50A' are illustrated in an initial position prior to being mated when the connectors 20 and 20' are aligned for mating as illustrated in FIG. 4. In particular, the housings 22 and 22' are positioned such that the header portion 44 and 44' are configured to be received and nested in the complementary receptacles 42' and 42, respectively. It should be appreciated that because the contacts 50A and 50A' are identically or substantially identically constructed, and because contacts 50B and 50B' are identically constructed, the description of mating of contacts 50B and 50A' as illustrated is applicable to the mating of all contacts 50B and 50A' in the rows 48 and 46', respectively, and is likewise applicable to the mating of all contacts 50A and 50B' in the rows 46 and 48', respectively.

As illustrated, the contacts 50B and 50A' are laterally offset with respect to each other such that the mating ends 54 and 54' of the distal portions 85 and 85' are aligned. In particular, the proximal convex regions 93 are aligned. It should be appreciated that in the illustrated embodiment, the contacts 50B and 50A' are mated by applying an external insertion force, or "insertion force" as used herein, that is required to cause the contacts to move transversely inward relative to each other. Hence both connectors 20 and 20' can be brought toward each other, or one of the connectors can be brought toward the other, while the other remains stationary. For the purposes of clarity, the process of mating will be described with respect to an embodiment whereby the connectors 20 and 20', and thus the contacts 50B and 50A', are moved toward each other in the transverse or vertical direction, it being appreciated that the actual direction of contact insertion during use will be dependent, for instance, on the orientation of the connectors 20 and 20'.

Figure 6B:
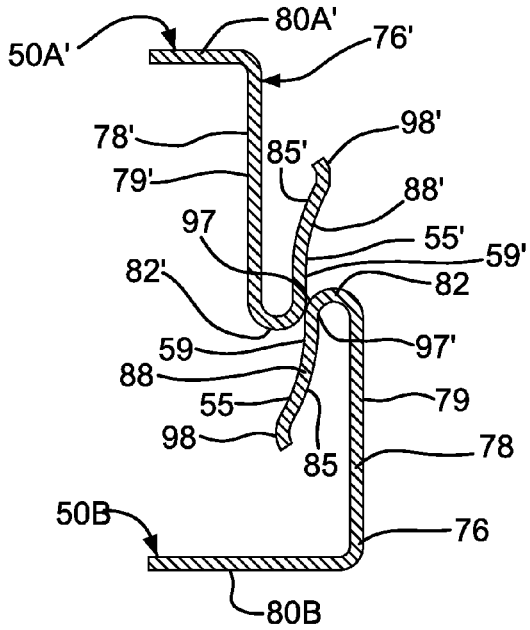
FIG. 6B is a side elevation view of the contacts illustrated in FIG. 6A in a first mating position.

Accordingly, as the contacts 50B and 50A' begin to mate from the initial position illustrated in FIG. 6A to a first intermediate mating position illustrated in FIG. 6B, the upsloped surfaces 63 and 63' contact and ride along each other until the peaks 97 and 97' of the proximal convex regions 93 and 93' are aligned. It should thus be appreciated that the proximal convex regions 93 and 93' provide a first contact location between the electrical contacts 50 and 50'. The mating surfaces 55 and 55' provide cam surfaces for each other as the contacts 50 and 50' are mated. Movement from the initial position to the first intermediate position causes the upsloped surface 63 to cam over upsloped surface 63', and the upsloped surface 63' to cam over the upsloped surface 63.

Figure 8:
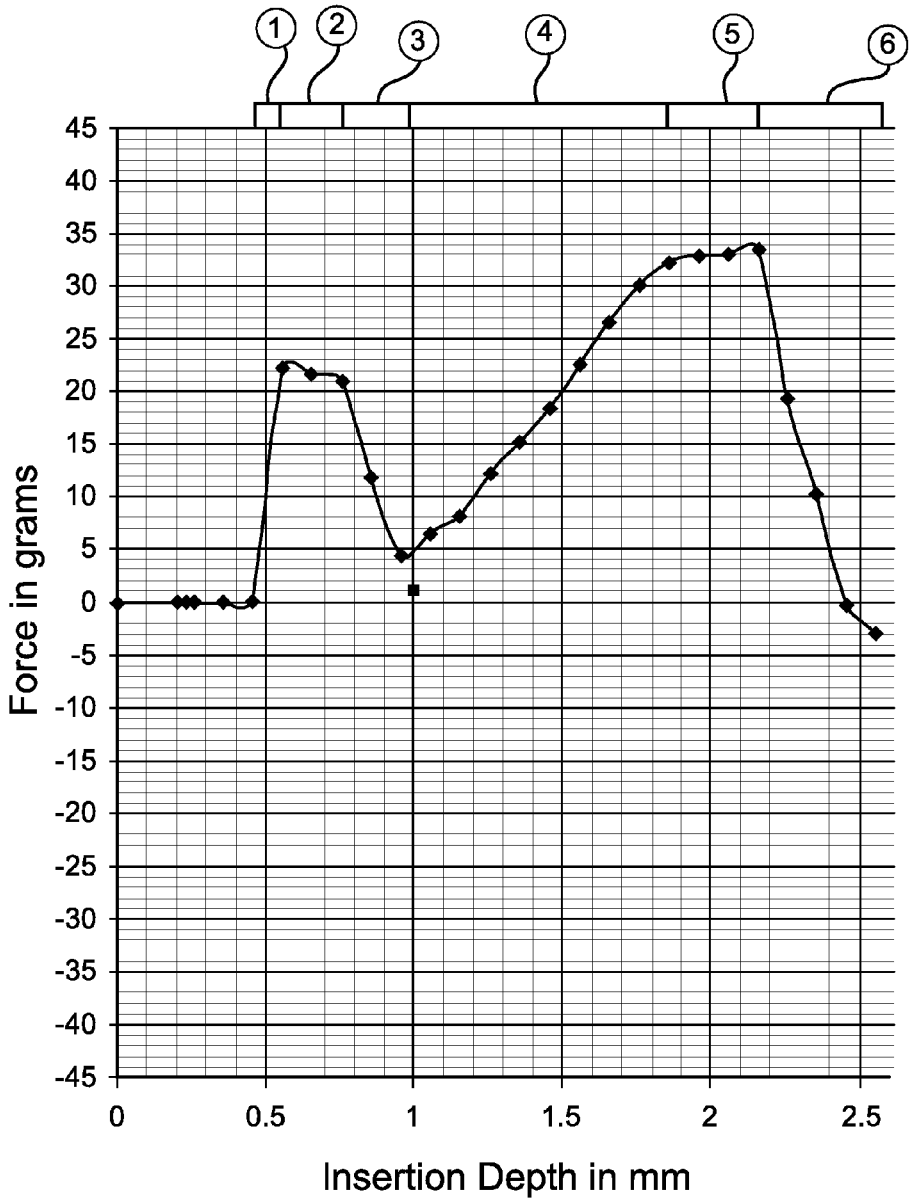
FIG. 8 is a graph plotting insertion force as a function of insertion distance as the electrical contacts illustrated in FIGS. 6A-F are mated.

The applied increasing insertion force that causes the peaks 97 and 97' to ride along the upsloped surfaces 63' and 63 provides tactile feedback that the contacts 50B and 50A' are being mated. For instance, referring to FIG. 8 no insertion force is present prior to engaging the mating ends 54 and 54'. As the upsloped surfaces 63 and 63' contact and ride along each other, the insertion force increases at zone 1 until the peaks 97 and 97' of the proximal convex regions 93 and 93' are aligned, at which point the insertion force levels off at zone 2. It should be appreciated that the insertion depths set forth in FIG. 8 is specific to a geometric configuration of the contacts 50 and 50', and that any Furthermore, the contacts 50B and 50A' flex laterally outward away from each other as the proximal convex regions 93 and 93' ride along each other. It should be appreciated that both the distal portions 85 and 85' and the proximal portions 79 and 79' of each contact 50B and 50A' deflect or yield away from the opposing contact as the contacts 50B and 50A' are mated. Accordingly, the contacts 50B and 50A' apply a spring force toward each other. Because the upsloped surfaces 63 and 63' flare laterally outward, the spring force biases the contacts 50 and 50' transversely away from each other as the upsloped surfaces 63 and 63' ride along each other until the peaks 97 and 97' are aligned. The biasing force is overcome by the insertion force as the contacts 50B and 50A' are moved from the initial position to the first intermediate mating position illustrated in FIG. 6B.

Figure 6C:
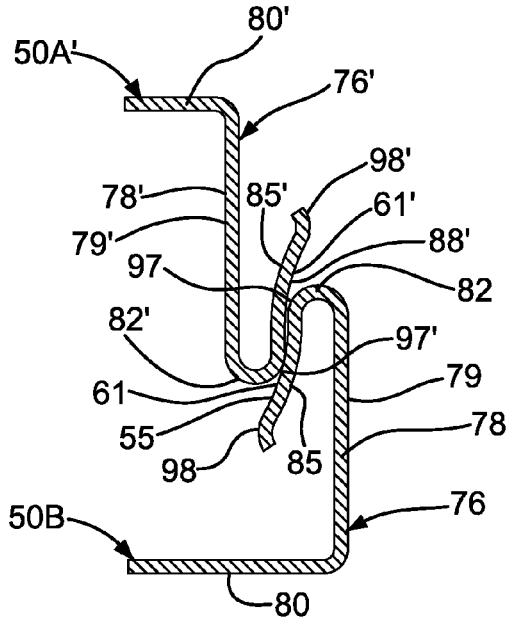
FIG. 6C is a side elevation view of the contacts illustrated in FIG. 6B in a second mating position.

As the contacts 50B and 50A' continue to mate from the first intermediate mating position illustrated in FIG. 6B to a second intermediate mating position illustrated in FIG. 6C, the peaks 97 and 97' slide past each other, and ride along the complementary downsloped surfaces 59' and 59, respectively. Because the downsloped surfaces 59' and 59 flare laterally outward less than the upsloped surfaces 63 and 63', the rate at which the insertion force increases as the contacts 50B and 50A' are continuously mated is reduced. In the illustrated embodiment, because the downsloped surfaces 59 and 59' flare laterally inward away from the complementary contact 50A' and 50B, the spring force applied by the peaks 97 and 97' onto the complementary surfaces 59' and 59 reduces the insertion force level when moving the contacts 50B and 50A' from the first intermediate mating position to the second intermediate mating position. In fact, if the frictional forces caused by the mating of the contacts and the housing walls were neglected, the engagement between the peaks 97 and 97' and the complementary downsloped surfaces 59' and 59 would reverse the insertion force, such that the contacts would automatic move from the first intermediate mating position toward the second intermediate mating position without applying any external insertion forces.

It should be appreciated that, unless otherwise indicated, a reduction of insertion force is intended to encompass both a reduction of the rate of insertion force increase and reduction in insertion force level, including a reversal in insertion force such that no external insertion force is necessary to further mate the contacts 50B and 50A'. Referring to FIG. 8, as the peaks 97 and 97' slide past each other, and ride along the complementary downsloped surfaces 59' and 59, respectively, the insertion force decreases until the peaks 97 and 97' contact the complementary valleys 89' and 89 as indicated at zone 3. In this regard, it should be appreciated that the valleys 89 and 89' need not be centered with respect to the respective concave regions 88 and 88', and in fact can be located anywhere along the concave region as desired.

Notably, once the peaks 97 and 97' engage the complementary downsloped surfaces 59' and 59 with continued insertion, the contacts 50B and 50A' will not be subject to detachment unless a separation force is applied that is sufficient to cause the peaks 97 and 97' to ride back over the downsloped surfaces 59' and 59, which would present upsloped surfaces with respect to separation. Thus, the contacts 50B and 50A' are not likely to become inadvertently separated from each other. Accordingly, it can be said that a first contact location provided by the peaks 97 and 97' and the complementary downsloped surfaces 59' and 59 has been mated when the contacts 50B and 50A' have moved to the second intermediate mating position illustrated in FIG. 6C. It should be appreciated that the reduction of insertion force provides tactile feedback that the first contact locations of each contact 50B and 50A' have mated.

Figure 6D:
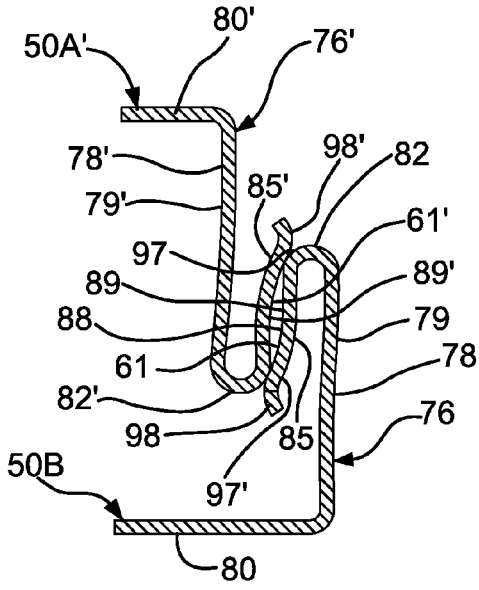
FIG. 6D is a side elevation view of the contacts illustrated in FIG. 6C in a third mating position.

As the contacts 50B and 50A' continue to mate from the second intermediate mating position illustrated in FIG. 6C to a third intermediate mating position illustrated in FIG. 6D, the peaks 97 and 97' slide past the complementary valleys 89' and 89, and ride along the complementary upsloped surfaces 61' and 61, respectively. Because the upsloped surfaces 61 and 61' flare laterally inward less than the downsloped surfaces 59 and 59', the rate at which the insertion force decreases as the contacts 50B and 50A' are continuously mated is reduced. In the illustrated embodiment, because the upsloped surfaces 61 and 61' flare laterally outward toward the complementary contact 50A' and 50B, the spring force applied by the peaks 97 and 97' onto the complementary surfaces 61' and 61 increases the insertion force level when mating the contacts 50B and 50A' from the second intermediate mating position to the third intermediate mating position. In fact, if the frictional forces caused by the mating of the contacts and the housing walls were neglected, the engagement between the peaks 97 and 97' and the complementary upsloped surfaces 61' and 61 would reverse the insertion force polarity achieved by the downsloped surfaces 59 and 59', such that the contacts would automatic move from the third intermediate mating position toward the second intermediate mating position without applying any external insertion forces. It should be appreciated that, unless otherwise indicated, an increase of insertion force is intended to encompass both a reduction of the rate of insertion force decrease and an increase of insertion force level.

Notably, once the peaks 97 and 97' engage the complementary upsloped surfaces 61' and 61 with continued insertion, the contacts 50B and 50A' become engaged at two contact locations. In particular, the first contact location is provided by the peak 97 and the complementary distal convex region 98', and the second contact location is provided by the peak 97' and the complementary distal convex region 98. It should be appreciated that the contacts 50B and 50A' provide a second increase of insertion force that provides tactile feedback that the pair of contact locations are being mated, as illustrated in FIG. 8 at zone 4. Because a pair of upsloped surfaces are engaging each other during the transition from the position illustrated at FIG. 6C to the position illustrated at FIG. 6D, the insertion force after the second increase is greater than the insertion force after the first increase. The first, or initial, increase of insertion force is provided when the contacts 50B and 50A' are mated from the position illustrated in FIG. 6A to the position illustrated in FIG. 6B.

Figure 6E:
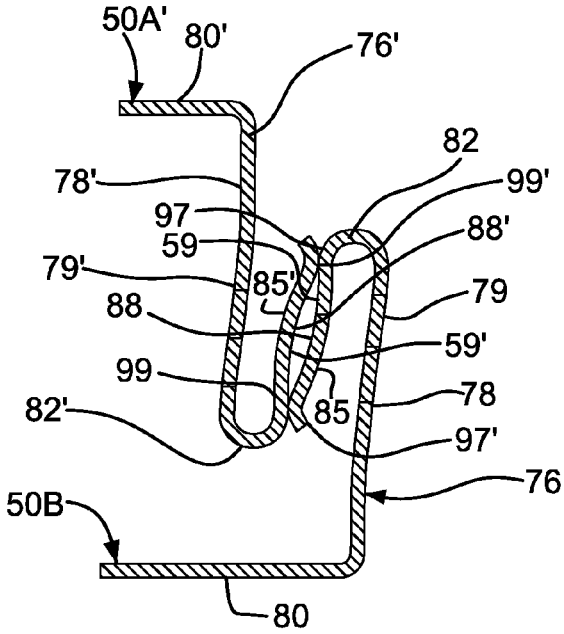
FIG. 6E is a side elevation view of the contacts illustrated in FIG. 6D in a fourth mating position.

As the contacts 50B and 50A' continue to mate from the third intermediate mating position illustrated in FIG. 6D to a fourth intermediate mating position illustrated in FIG. 6E, the peaks 97 and 97' slide past the complementary upsloped surfaces 61' and 61 under an increasing insertion force to a location whereby the peaks 97 and 97' of the proximal convex region 93 are aligned with the complementary peaks 99' and 99 of the distal convex region 98.

As the contacts 50B and 50A' continue to mate from the third intermediate mating position illustrated in FIG. 6D to a fourth intermediate mating position illustrated in FIG. 6E, the peaks 97 and 97' slide past the complementary upsloped surfaces 61' and 61 under an increasing insertion force to a location whereby the peaks 97 and 97' of the proximal convex region 93 are aligned with the complementary peaks 99' and 99 of the distal convex region 98. As illustrated in FIG. 8, the insertion force levels out at zone 5 with respect to insertion force increase indicated at zone 4.

Figure 6F:
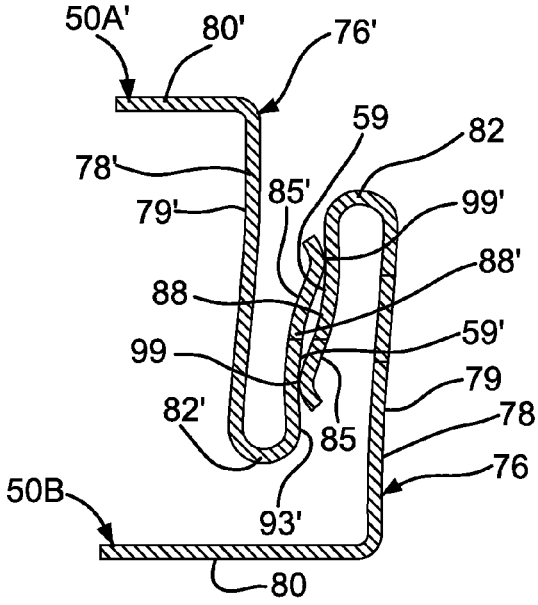
FIG. 6F is a side elevation view of the contacts illustrated in FIG. 6E in a fully mated position.

As the contacts 50B and 50A' continue to mate from the fourth intermediate position illustrated in FIG. 6E to a final fully mated position illustrated in FIG. 6F, the peaks 97 and 97' slide past the complementary peaks 99' and 99, and are thus not in physical contact with the complementary mating surface 55' and 55, respectively. Additionally, the peaks 99 and 99' ride along the complementary downsloped surfaces 59' and 59, respectively, thereby reducing the insertion force level when moving the contacts 50B and 50A' from the fourth intermediate position to the fully mated position. The contacts 50B and 50A' are fully mated when the peaks 99 and 99' are disposed against the concave region 88. In the illustrated embodiment, the contacts 50B and 50A' are fully mated when the peaks 99 and 99' are disposed upstream of the complementary valleys 89' and 89.

Notably, once the peaks 99 and 99' the first and second contact locations will not be subject to detachment unless a separation force is applied that is sufficient to cause the peaks 99 and 99' to ride back over the downsloped surfaces 59' and 59, which would present upsloped surfaces with respect to separation. Thus, the contacts 50B and 50A' are not likely to become inadvertently separated from each other. Accordingly, it can be said that a first contact location defined by the peak 99 and the complementary concave region 88', and a second contact location is defined by the peak 99' and the complementary concave region 88 have been fully mated.

Referring to FIG. 8, the contacts 50B and 50A' provide a second decrease of insertion force as indicated at zone 6. Because a pair of contact locations ride down complementary downslopes, the second insertion force decrease is greater in magnitude than the first insertion force decrease provided at zone 3, and provided when the contacts 50B and 50A' are mated from the position illustrated in FIG. 6B to the position illustrated in FIG. 6C. In the illustrated embodiment, the second insertion force reduction produces an insertion force that is below zero. Accordingly, the insertion force reverses polarity, as the contacts 50B and 50A' provide a force that assists in reaching their fully mated position. It should be appreciated that the second insertion force reduction provides tactile feedback that the first and second contact locations of each contact 50B and 50A' have fully mated.

As illustrated in FIG. 7, the connectors 20 and 22' are fully mated when the transverse outer, or upper, ends of the side walls 36 and 38 abut the transverse outer ends of the complementary side walls 38' and 36', and the transverse outer ends of the divider walls 56 and 56' engage the complementary base 45' and 45. The fully mated position can be achieved when the peaks 97 and 97' are biased against the concave regions 88' and 88 anywhere along the downsloped surfaces 59' and 59, thereby providing positional play when achieving the fully mated position. The positional play allows for the contacts 50B and 50A' to wipe against each other while maintaining the first and second contact locations in their mated positions.

It should be appreciated that when mating the contacts 50B and 50A' from the initial aligned position to the fully mated position, a first increase of insertion force provides tactile feedback when a first contact location begins to mate. A first reduction of insertion force provides tactile feedback when the first contact location is mated. A second increase of insertion force provides tactile feedback when a second contact location begins to mate, and a second reduction of insertion force provides tactile feedback when the first and second contact locations are fully mated.

In this regard, it should be appreciated that two separate and spaced contact locations of the contacts 50B and 50A' ride along the downsloped surfaces 59' and 59 when the contacts 50B and 50A' are mated. It should be further appreciated that the contacts 50B and 50A' define a wiping distance along the respective distal portions 85 and 85' between the proximal convex regions 93 and 93' and the peaks 99 and 99' of the distal convex regions 98 and 98', respectively. Furthermore, the distance between the peaks 97 and 99 is not greater than the total wiping distance of the mating surface 55. In the illustrated embodiment, the contacts 50B and 50A' begin to mate at a location upstream of the peaks 97 and 97', and as a result, the distance between the peaks 97 and 99 is less that the total wiping distance.

With continuing reference to FIGS. 6A-F, it should be appreciated that during insertion, both the proximal portions 79 and 79' and the distal portions 85 and 85' deflect, or yield away from the complementary contact. That is, the effective length of each of the contacts 50 and 50' (i.e., the length of the contacts that are configured to yield during insertion) is greater than the height of the contact. The effective contact length is measured along the contact 50 from the base 45 to the distal contact location, which is the peak 99 of the distal convex region 98 as illustrated, while the contact height H (see FIG. 3) is measured from the interface 49 where the contact 50 extends out from the base 45 to the upper end of the bent portion 82. In the illustrated embodiment, the effective length is between 125% and 200% of the height H, though it should be appreciated from FIG. 3 that the terminal end 87 could extend below the interface 49, thereby increasing the effective length to greater than 200% of the height H, for instance up to 225% in alternative embodiments As a result, the insertion force to mate the contacts 50 and 50' is reduced with respect to an insertion force required to mate a similarly constructed contact whose effective length is equal to the height of the contact 50, because the similarly constructed contact would undergo the same amount of cumulative flexing, but the flexing would occur over a shorter effective length than the contact 50, which would increase the insertion forces. As a result, the contact 50 can be configured with a low vertical profile without significantly increasing the insertion forces by providing an effective length that is greater than the height of the contact, thereby. In the illustrated embodiment, the height H of the contact 50 is less than 5 mm, and substantially equal to 4 mm.

The embodiments described in connection with the present invention have been presented by way of illustration, and the present invention is therefore not intended to be limited to the disclosed embodiments. Accordingly, those skilled in the art will realize that the invention is intended to encompass all modifications and alternative arrangements included within the spirit and scope of the invention, as set forth by the appended claims.

What is claimed:

1. An electrical connector comprising:

a housing; and at least one electrical contact supported by the housing, the electrical contact defining a contact body extending out from the housing, a mounting end disposed upstream of the contact body, a mating end disposed downstream of the contact body, and a bent portion connected between the mounting end and the mating end, wherein the mating end extends inward toward the housing such that the mating end is spaced from the contact body, the mating end defines a mating surface having a proximal convex region, a concave region disposed downstream of the proximal convex region, and a distal convex region disposed downstream of the concave region, the proximal convex region defines a downsloped surface that extends toward the contact body along a direction toward the concave region, and the convex region defines a peak disposed between a pair of downsloped surfaces that extend toward the contact body in a direction outward from the peak.

2. The electrical connector as recited in claim 1, wherein the concave region is disposed immediately adjacent the proximal and distal convex regions.

3. The electrical connector as recited in claim 1, wherein the concave region defines a curvature that is more shallow than that of the proximal and distal convex regions.

4. The electrical connector as recited in claim 1, wherein the mating end overlaps the contact body with respect to a common axis that extends substantially perpendicular to the contact body.

5. The electrical connector as recited in claim 4, further comprising a bent portion connected between the proximal and distal portions of the contact.

6. The electrical connector as recited in claim 5, wherein the bent portion is substantially U-shaped.

7. The electrical connector as recited in claim 1, wherein the downsloped surface that is disposed downstream of the peak extends in a direction toward the stem.

8. The electrical connector as recited in claim 1, wherein the mating end is gender neutral.

9. The electrical connector as recited in claim 1, wherein the electrical contact is an electrical signal contact.

10. An electrical connector comprising:

a housing;

at least one electrical contact supported by the housing, the electrical contact including:

a stem;

a mounting portion connected to one end of the stem, the mounting end configured to electrically connect to a complementary electrical component; and a mating end connected to another end of the stem by a substantially u-shaped bent portion, the mating end defining a concave mating surface disposed between a pair of convex mating surfaces, wherein each of the convex mating surfaces defines a corresponding peak disposed between a pair of adjacent inwardly sloped surfaces that extend along a direction toward the stem such that the mating end is configured to electrically connect to an substantially identically constructed mating end of an electrical contact of a complementary connector when the electrical connector and the complementary connector are mated.

11. The electrical connector as recited in claim 10, wherein the concave mating surface is disposed between a pair of convex mating surfaces, each convex mating surfaces defining a pair of adjacent inwardly sloped surfaces.

12. The electrical connector as recited in claim 11, wherein the concave region defines a curvature that is more shallow than that of the convex regions.

13. The electrical connector as recited in claim 11, wherein the concave region is disposed immediately adjacent the convex regions, such that one of the inwardly sloped surfaces of each of the convex mating surfaces extends toward a valley of the concave region.

14. An electrical connector assembly comprising:

a first electrical connector configured to mate with a second electrical connector, each electrical connector including a housing and at least one electrical contact supported by the housing, such that the electrical contacts of the first and second electrical connectors are configured to mate at a first contact location and a second contact location;

wherein an insertion force that mates the first and second electrical connectors undergoes a first increase as the first contact locations are mated, a first reduction when the first contact locations are mated, a second increase as the second contact locations are mated, and a second reduction when the second contact locations are mated.

15. The electrical connector assembly as recited in claim 14, wherein each electrical contact comprises a downsloped surface that is configured to ride against the first and second contact locations as the first and second electrical connectors are mated.

16. The electrical connector assembly as recited in claim 15, wherein the downsloped surface of each electrical contact is disposed between first and second upsloped surfaces, such that a first peak is disposed upstream of the downsloped surface, and a second peak is disposed downstream of the downsloped surface, and the first peak of each electrical contact is disposed downstream of the second peak of the other contact when the electrical connectors are mated.

17. The electrical connector assembly as recited in claim 16, wherein the second peak of each electrical contact contacts the downsloped surface of the other electrical contact when the electrical connectors are mated.

18. The electrical connector assembly as recited in claim 14, wherein each electrical contact comprises a concave region disposed between a pair of convex regions, each convex region defining a peak disposed between a pair of surfaces that are recessed with respect to the peak.

19. The electrical connector assembly as recited in claim 18, wherein the concave region is disposed immediately adjacent the convex regions.

20. The electrical connector assembly as recited in claim 14, wherein the electrical contacts of the first and second electrical connectors are gender-neutral.

21. The electrical connector assembly comprising:

a first electrical connector configured to mate with a second electrical connector, each electrical connector including a housing and at least one electrical contact supported by the housing, such that the at least one electrical contact of the first and second electrical connectors are configured to mate at a first contact location and a second contact location;

wherein the at least one electrical contact of the first electrical connector mates with the at least one electrical contact of the second electrical connector so as to produce an insertion force that undergoes a first increase as the first contact locations are mated, a first reduction when the first contact locations are mated, a second increase as the second contact locations are mated, and a second reduction when the second contact locations are mated.

22. The electrical connector assembly as recited in claim 21, wherein each electrical contact comprises a downsloped surface that extends downstream of the first and second contact locations.

23. The electrical connector assembly as recited in claim 21, wherein each electrical contact comprises a concave region disposed between a pair of convex regions, each convex region defining a peak disposed between a pair of surfaces that are recessed with respect to the peak.

24. The electrical connector assembly as recited in claim 23, wherein the concave region is disposed immediately adjacent the convex regions.

25. The electrical connector assembly as recited in claim 21, wherein the at least one electrical contact of the first and second electrical connectors are gender-neutral.

* * * * *